US006536927B1

(12) United States Patent
Lawnicki

(10) Patent No.: US 6,536,927 B1
(45) Date of Patent: Mar. 25, 2003

(54) LIGHT FIXTURE EXTENSION ADAPTER

(76) Inventor: Victor F. Lawnicki, 1159 Hidalgo Dr., Laramie, WY (US) 82072

( * ) Notice: Subject to any disclaimer, the term of this patent is extended or adjusted under 35 U.S.C. 154(b) by 0 days.

(21) Appl. No.: 09/975,922

(22) Filed: Oct. 10, 2001

(51) Int. Cl.[7] ..... F21V 17/00

(52) U.S. Cl. ..... 362/448; 362/449; 362/439; 362/404; 439/339

(58) Field of Search ..... 362/488, 449, 362/226, 404, 437, 439; 439/339

(56) References Cited

U.S. PATENT DOCUMENTS

| | | | | |
|---|---|---|---|---|
| 2,675,466 A | | 4/1954 | Baker | 240/78 |
| 3,825,743 A | | 7/1974 | Riley | 240/144 |
| 4,186,433 A | | 1/1980 | Baldwin | 362/263 |
| 4,428,032 A | | 1/1984 | Workman | 362/96 |
| 4,850,900 A | | 7/1989 | Yarmark | 439/648 |
| 4,851,981 A | | 7/1989 | Ruesch | 362/452 |
| 5,079,684 A | | 1/1992 | Lai | 362/294 |
| 5,273,452 A | * | 12/1993 | Donato et al. | 362/226 |
| 5,404,286 A | * | 4/1995 | Boutges | 362/287 |
| 5,467,259 A | | 11/1995 | Hume et al. | 362/307 |
| 5,597,233 A | | 1/1997 | Lau | 362/294 |
| 6,193,390 B1 | | 2/2001 | Sakakibara et al. | 362/216 |

* cited by examiner

*Primary Examiner*—Sandra O'Shea
*Assistant Examiner*—Ali Alavi
(74) *Attorney, Agent, or Firm*—Flanagan & Flanagan; John R. Flanagan

(57) ABSTRACT

A light fixture extension adapter includes a body, a male stud on one opposite end portion of the body for extending through a mounting hole in a light fixture cover extending between opposite outer and inner faces of the light fixture cover and adapted for fastening a cap of the light fixture on the male stud so as to dispose the light fixture cap adjacent to the outer face of the light fixture cover, a female socket on the other opposite end portion of the body and disposed adjacent to the inner face of the light fixture cover and adapted for fastening a nipple of a light fixture thereto, and an abutment structure disposed on the body for abutting against the inner face of the light fixture cover such that upon fastening the light fixture cap on the male stud the light fixture cover is clamped between the abutment structure and light fixture cap.

20 Claims, 2 Drawing Sheets

LIGHT FIXTURE EXTENSION ADAPTER

BACKGROUND OF THE INVENTION

1. Field of the Invention

The present invention generally relates to light fixtures and shades or covers therefor and, more particularly, is concerned with a light fixture extension adapter for enabling a fluorescent light bulb to replace an incandescent light bulb of smaller size in a light fixture without interfering with a standard light cover used with the light fixture.

2. Description of the Prior Art

In recent years, compact fluorescent light bulbs have been introduced to the consumer market which are substantially longer lasting and consume much less electrical energy than standard incandescent light bulbs. Millions of existing homes of consumers employ light fixtures in which incandescent light bulbs could be replaced by compact fluorescent light bulbs such that a considerable reduction of electrical energy usage could be realized.

However, one of these types of existing light fixtures that is a commonly employed on a wall or ceiling, a bracket having a first portion mounted to and extending outwardly from the wall or ceiling, one or more electrical sockets supported by and about and extending radially outwardly from the first portion of the bracket for threadably receiving one or more incandescent light bulbs of a standard size, the bracket also having a second portion attached to and extending outwardly from the first portion of the bracket and having a threaded end or nipple, and a light shade or cover that has a mounting hole allowing the cover to fit over the nipple such that the cover can be retained on the second portion of the bracket by a cap that is screwed on the nipple. This light cover is thus supported by the bracket so as to cover the incandescent light bulbs and be disposed in a closely spaced relationship therefrom.

While the electrical sockets of this common wall or ceiling light fixture are capable of accommodating the aforementioned recent compact fluorescent light bulbs in place of the traditional or standard incandescent light bulbs, these compact fluorescent light bulbs are sufficiently larger in size than the standard incandescent light bulbs such that the second portion of the bracket is thereby too short to allow reinstallation of the light cover thereon without the light cover making interfering contact with the compact fluorescent light bulbs. This prevents these compact fluorescent light bulbs from being used in the aforementioned type of existing wall or ceiling light fixtures and thus greatly reduces the possible numbers there that can be used in existing homes.

Consequently, a need exists for an innovation which will provide a solution to the aforementioned problem in the prior art without introducing any new problems in place thereof.

SUMMARY OF THE INVENTION

The present invention provides a light fixture extension adapter designed to satisfy the aforementioned need. The light fixture extension adapter of the present invention adds sufficient length to the second portion of the bracket of the existing wall or ceiling light fixture so as to allow compact fluorescent light bulbs to be used in place of incandescent light bulbs of smaller size without interfering with the reinstallation of the standard light cover used with such light fixture.

Accordingly, the present invention is directed to a light fixture extension adapter which comprises: (a) an elongated body having opposite end portions; (b) a male stud on one of the opposite end portions of the elongated body for extending through a mounting hole in a cover of a light fixture defined so as to extend between opposite outer and inner faces of the light fixture cover, the male stud having means for fastening a cap of the light fixture on the male stud so as to dispose the light fixture cap adjacent to the outer face of the light fixture cover; (c) a female socket on the other of the opposite end portions of the elongated body and disposed adjacent to the inner face of the light fixture cover, the female socket having means for fastening a nipple of a light fixture to the female socket; and (d) means disposed on the elongated body for abutting the inner face of the light fixture cover such that upon fastening the light fixture cap on the male stud the light fixture cover is clamped between the abutting means and the light fixture cap.

More particularly, the fastening means of the male stud is external threads for threadably tightening internal threads of the cap of the light fixture on the male stud so as to dispose the light fixture cap adjacent to the outer face of the light fixture cover. The fastening means of the female socket is internal threads for threadably receiving external threads of the nipple of the light fixture. The male stud and female socket are coaxially aligned with one another by the elongated body.

In a first embodiment, the elongated body has a cylindrical-shaped configuration. The abutting means is an annular flange attached to and extending about and radially outwardly from the elongated body generally between the opposite end portions thereof.

In a second embodiment, the elongated body is a bracket having a U-shaped configuration and the opposite end portions of the elongated body are a pair of legs laterally spaced apart from one another. The elongated body also has a middle bight extending between and interconnecting the legs such that the male stud is attached to one of the legs and the female socket is attached to the other of the legs.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
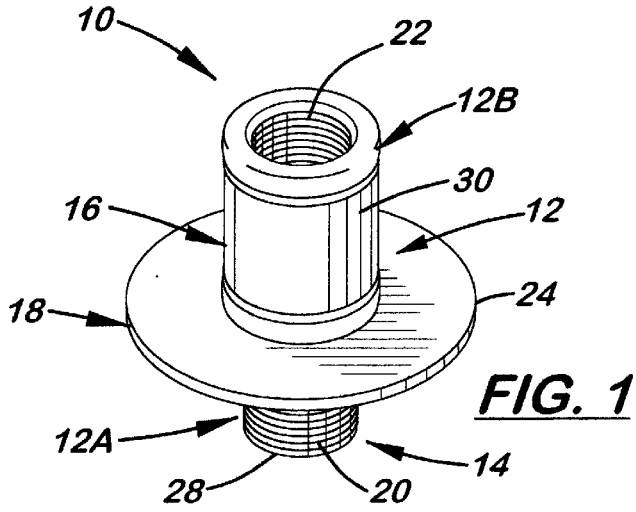
FIG. 1 is a perspective view of a first exemplary embodiment of a light fixture extension adapter of the present invention.
Figure 2:
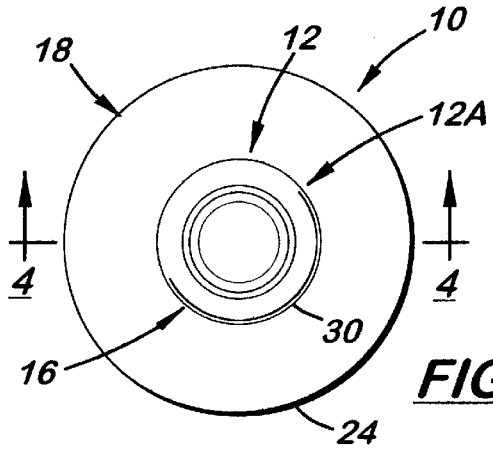
FIG. 2 is a top plan view of the extension adapter as seen along line 2—2 of FIG. 3.
Figure 3:
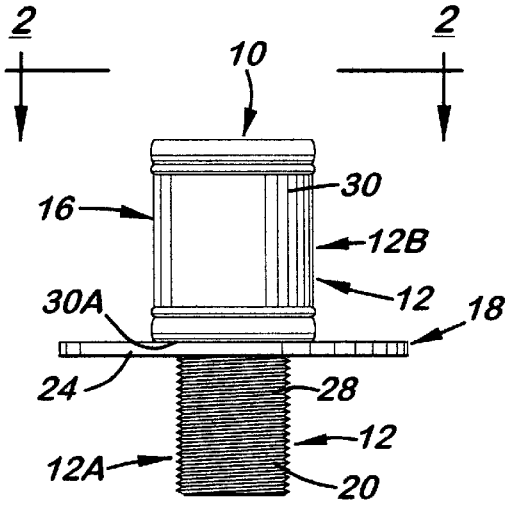
FIG. 3 is a side elevational view of the extension adapter of FIG. 1.
Figure 4:
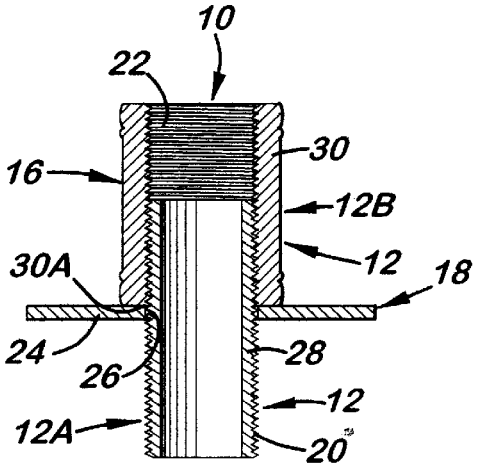
FIG. 4 is a longitudinal sectional view of the extension adapter taken along line 4—4 of FIG. 2.
Figure 5:
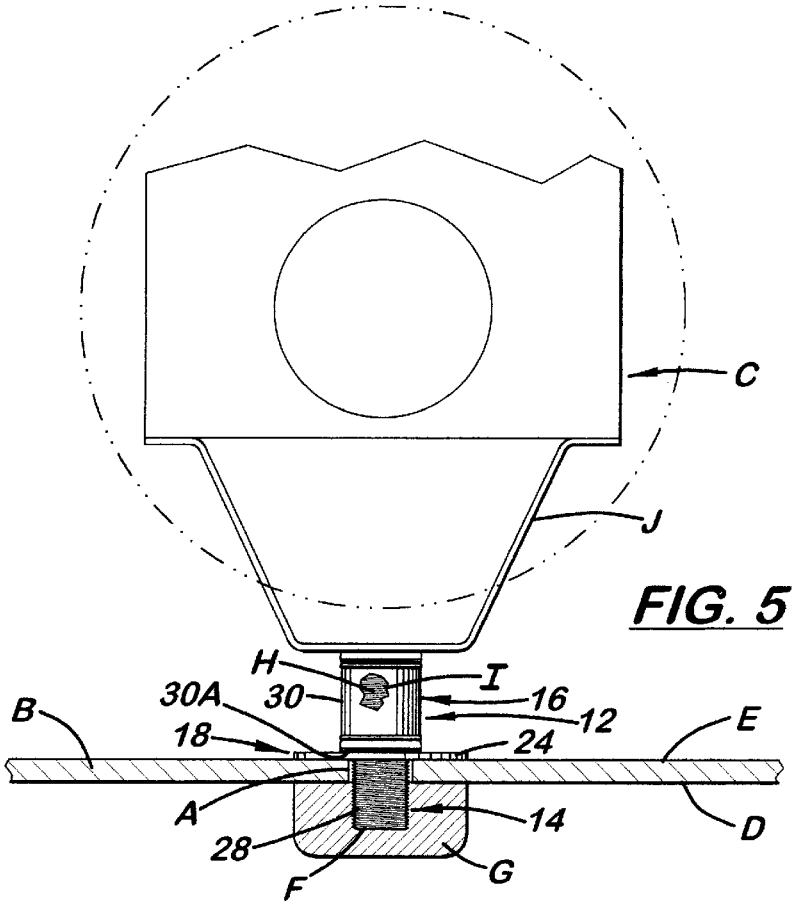
FIG. 5 is a fragmentary side elevational view, with portions in sectional form, of the extension adapter of FIG. 1 installed in a conventional ceiling light fixture.

Referring to the drawings, there are illustrated two exemplary embodiments of a light fixture extension adapter, generally designated 10, of the present invention. Basically, the extension adapter 10 includes an elongated body 12 having opposite end portions 12A, 12B, a male stud 14 on one opposite end portion 12A of the elongated body 12 for extending through a mounting hole A in a shade or cover B of a ceiling or wall light fixture C, as seen in FIG. 5, which hole A is defined so as to extend between opposite outer and inner faces D, E of the light fixture cover B, a female socket 16 on the other opposite end portion 12B of the elongated body 12 and disposed adjacent to the inner face D of the light fixture cover B, and an abutment means 18 mounted and disposed on the elongated body 12 for abutting against the inner face D of the light fixture cover B. Additionally, the male stud 14 has fastening means thereon, such as in the form of external threads 20, for fastening by way of threadably tightening of internal threads F of a cap G of the light fixture A with the external threads 20 of the male stud 14 so as to dispose the light fixture cap G adjacent to the outer face E of the light fixture cover B. The female socket 16 also has fastening means thereon, such as in the form of internal threads 22, for fastening by way of threadably receiving and tightening external threads H of a nipple I on a bracket J of the light fixture B with the internal threads 22 of the female socket 16. Thus, as seen in FIG. 5, after placing the light fixture cover B over the nipple I of the light fixture B and upon threadably tightening the light fixture cap G on the male stud 14 the light fixture cover B becomes securely clamped between the abutment means 18 and the light fixture cap G. The elongated body 12 of the adapter 10 supports the male stud 14 and female socket 16 in coaxial alignment with one another along a common axis. It will be recognized that the respective fastening means of the respective parts can take forms other than threads, for example, releasable snap fittings.

Referring to FIGS. 1–5, there is illustrated a first exemplary embodiment of the adapter 10. The elongated body 12 of the first embodiment of the adapter 10 has an overall generally cylindrical-shaped configuration. In the first exemplary embodiment, the abutment means 18 of the adapter 10 is an annular flange 24 having a central opening 26. In an exemplary form, the elongated body 12 can be constructed using a pair of tubular cylindrical-shaped sleeves 28, 30 which are open at their opposite ends and respectively have the external threads 20 and internal threads 22 thereon. The one sleeve 28 has an outside diameter less than the inside diameter of the other sleeve 30 allowing the one sleeve 28 to be screwed over a portion of its length into the other sleeve 30 such that the one sleeve 28 forms the male stud 14 and the other sleeve 30 forms the female socket 16. The central opening 26 of the annular flange 24 is just enough greater in diameter than the outside diameter of the one sleeve 28 to allow the annular flange 24 to be slid over the one sleeve 28 and into abutting relationship against an end 30A of the other sleeve male where the annular flange 24 can be fixedly attached in any suitable manner, such as by gluing, to the one sleeve 28 and/or the other sleeve 30. In such position, the annular flange 24 projects radially outwardly from the sleeves 28, 30 and thus the male stud 14 and female socket 16 on the elongated body 12 at a location generally between the opposite end portions 12A, 12B thereof. It will be recognized that the elongated body 12 and the male stud 14 and female socket 16 thereof could be constructed in other suitable ways, one of which is by being casted as a one-piece unit.

Figure 6:
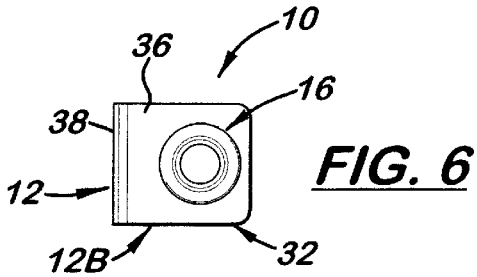
FIG. 6 is a top plan view of a second exemplary embodiment of a light fixture extension adapter of the present invention.
Figure 7:
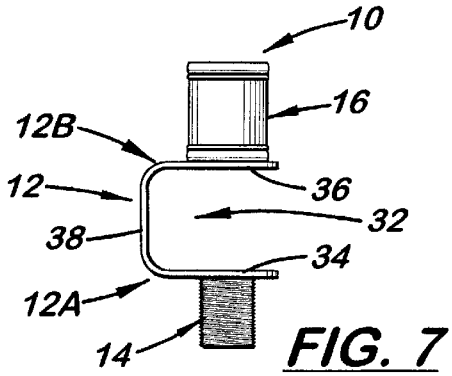
FIG. 7 is a side elevational view of the extension adapter of FIG. 6.

Referring to FIGS. 6 and 7, there is illustrated a second exemplary embodiment of the adapter 10. The elongated body 12 of the second embodiment of the adapter 10 takes the form a bracket 32 having a U-shaped configuration and the opposite end portions 12A, 12B of the elongated body 12 are in the form of a pair of legs 34, 36 laterally spaced apart from and extending generally parallel to one another. The bracket 32 also has a middle bight 38 extending between and integrally interconnecting the legs 34, 36 such that the male stud 14 is fixedly attached to one of the legs 34 and the female socket 16 is fixedly attached to the other of the legs 36. Thus, the bracket 32 is disposed between the male stud 14 and female socket 16 and the male stud 14 and female socket 16 are coaxially aligned with one another by the bracket 32 along a common axis. In the first exemplary embodiment, the abutment means 18 is the leg 34 that surrounds and extends outwardly from the male socket 14 such that the light fixture cover B will be securely clamped between that leg 34 and the cap G.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A light fixture extension adapter, comprising:

(a) an elongated body having opposite end portions;

(b) a male stud on one of said opposite end portions of said elongated body for extending through a mounting hole in a cover of a light fixture defined so as to extend between opposite outer and inner faces of the light fixture cover, said male stud having means for fastening a cap of the light fixture on said male stud so as to dispose the light fixture cap adjacent to the outer face of the light fixture cover;

(c) a female socket on the other of said opposite end portions of said elongated body and disposed adjacent to the inner face of the light fixture cover, said female socket having means for fastening a nipple of a light fixture to said female socket; and (d) means disposed on said elongated body for abutting against the inner face of the light fixture cover such that upon fastening the light fixture cap on the male stud the light fixture cover is clamped between said abutting means and the light fixture cap.

2. The adapter of claim 1 wherein said fastening means of said male stud is external threads for threadably tightening internal threads of the cap of the light fixture on said male stud so as to dispose the light fixture cap adjacent to the outer face of the light fixture cover.

3. The adapter of claim 1 wherein said fastening means of said female socket is internal threads for threadably receiving external threads of the nipple of the light fixture.

4. The adapter of claim 3 wherein said fastening means of said male stud is external threads for threadably tightening internal threads of the cap of the light fixture on said male stud so as to dispose the light fixture cap adjacent to the outer face of the light fixture cover.

5. The adapter of claim 1 wherein said elongated body has a cylindrical-shaped configuration.

6. The adapter of claim 1 wherein said abutting means is an annular flange attached to and extending about and radially outwardly from said elongated body generally between said opposite end portions thereof.

7. The adapter of claim 1 wherein said elongated body is a bracket having a U-shaped configuration.

8. The adapter of claim 1 wherein said opposite end portions of said elongated body are a pair of legs laterally spaced apart from one another, said elongated body also having a middle bight extending between and interconnecting the legs such that said male stud is attached to one of said legs and said female socket is attached to the other of said legs.

9. The adapter of claim 1 wherein said male stud and female socket are coaxially aligned with one another by said elongated body.

10. A light fixture extension adapter, comprising:

(a) an elongated cylindrical body having opposite end portions;

(b) a male stud on one of said opposite end portions of said elongated body for extending through a mounting hole in a cover of a light fixture defined so as to extend between opposite outer and inner faces of the light fixture cover, said male stud having means for fastening a cap of the light fixture on said male stud so as to dispose the light fixture cap adjacent to the outer face of the light fixture cover;

(c) a female socket on the other of said opposite end portions of said elongated body and disposed adjacent to the inner face of the light fixture cover, said female socket having means for fastening a nipple of a light fixture to said female socket; and (d) an annular flange attached to and extending about and projecting radially outwardly from said elongated body generally between said opposite end portions thereof for abutting against the inner face of the light fixture cover such that upon fastening the light fixture cap on the male stud the light fixture cover is clamped between said annular flange and the light fixture cap.

11. The adapter of claim 10 wherein said fastening means of said male stud is external threads for threadably tightening internal threads of the cap of the light fixture on said male stud so as to dispose the light fixture cap adjacent to the outer face of the light fixture cover.

12. The adapter of claim 10 wherein said fastening means of said female socket is internal threads for threadably receiving external threads of the nipple of the light fixture.

13. The adapter of claim 12 wherein said fastening means of said male stud is external threads for threadably tightening internal threads of the cap of the light fixture on said male stud so as to dispose the light fixture cap adjacent to the outer face of the light fixture cover.

14. The adapter of claim 10 wherein said male stud and female socket are coaxially aligned with one another by said elongated body.

15. A light fixture extension adapter, comprising:

(a) a bracket of a generally U-shaped configuration and having a pair of opposite end legs laterally spaced apart from one another and a middle bight extending between and connected with said legs;

(b) a male stud attached to one of said legs of said bracket and extending outwardly therefrom in a first direction for extending through a mounting hole in a cover of a light fixture defined so as to extend between opposite outer and inner faces of the light fixture cover, said male stud having means for fastening a cap of the light fixture on said male stud so as to dispose the light fixture cap adjacent to the outer face of the light fixture cover;

(c) a female socket attached to the other of said legs of said bracket and extending outwardly therefrom in a second direction opposite to said first direction such that said female socket is disposed adjacent to the inner face of the light fixture cover, said female socket having means for fastening a nipple of a light fixture to said female socket;

(d) said one leg of said bracket defining means for abutting against the inner face of the light fixture cover such that upon fastening the light fixture cap on the male stud the light fixture cover is clamped between said abutting means and the light fixture cap.

16. The adapter of claim 15 wherein said fastening means of said male stud is external threads for threadably tightening internal threads of the cap of the light fixture on said male stud so as to dispose the light fixture cap adjacent to the outer face of the light fixture cover.

17. The adapter of claim 15 wherein said fastening means of said female socket is internal threads for threadably receiving external threads of the nipple of the light fixture.

18. The adapter of claim 17 wherein said fastening means of said male stud is external threads for threadably tightening internal threads of the cap of the light fixture on said male stud so as to dispose the light fixture cap adjacent to the outer face of the light fixture cover.

19. The adapter of claim 15 wherein said bracket is disposed between said male stud and said female socket.

20. The adapter of claim 15 wherein said male stud and female socket are coaxially aligned with one another by said elongated body.

* * * * *